US006712455B2

(12) United States Patent
Dante

(10) Patent No.: US 6,712,455 B2
(45) Date of Patent: Mar. 30, 2004

(54) PIEZOELECTRICALLY DRIVEN PRINTHEAD ARRAY

(75) Inventor: Henry M. Dante, Midlothian, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 10/107,217

(22) Filed: Mar. 28, 2002

(65) Prior Publication Data

US 2002/0140781 A1 Oct. 3, 2002

Related U.S. Application Data

(60) Provisional application No. 60/279,658, filed on Mar. 30, 2001.

(51) Int. Cl.[7] ..... B41J 2/045
(52) U.S. Cl. ..... 347/68
(58) Field of Search ..... 347/40, 44, 47, 347/54, 68–72; 310/311, 366, 324

(56) References Cited

U.S. PATENT DOCUMENTS

| | | | | |
|---|---|---|---|---|
| 3,946,398 A | | 3/1976 | Kyser et al. | |
| 4,730,197 A | | 3/1988 | Raman et al. | |
| 4,888,598 A | | 12/1989 | Heinzl et al. | |
| 5,371,527 A | | 12/1994 | Miller et al. | |
| 5,801,732 A | | 9/1998 | Pengelly | |
| 5,828,394 A | | 10/1998 | Khuri-Yakub et al. | |
| 5,838,350 A | | 11/1998 | Newcombe et al. | |
| 5,959,643 A | | 9/1999 | Temple et al. | |
| 6,014,153 A | | 1/2000 | Harvey | |
| RE36,667 E | | 4/2000 | Michaelis et al. | |
| 6,070,973 A | | 6/2000 | Sachs et al. | |
| 6,079,820 A | | 6/2000 | Dijksman et al. | |
| 6,123,405 A | | 9/2000 | Temple et al. | |
| 6,213,589 B1 | | 4/2001 | Silverbrook | |
| 6,227,654 B1 | | 5/2001 | Silverbrook | |
| 6,357,866 B1 | | 3/2002 | van Rensburg | |
| 6,474,786 B2 | * | 11/2002 | Percin et al. | 347/54 |
| 6,474,787 B1 | * | 11/2002 | Cruz-Uribe | 347/54 |

FOREIGN PATENT DOCUMENTS

| | | | | |
|---|---|---|---|---|
| EP | 0416540 A2 | * | 3/1991 | 347/68 |

OTHER PUBLICATIONS

Notification of Transmittal of the International Preliminary Examination Report dated Mar. 27, 2003 for PCT/US02/09582.

Notification of Transmittal of the International Search Report or the Declaration dated Aug. 20, 2002.

* cited by examiner

*Primary Examiner*—Russell Adams
*Assistant Examiner*—An H. Do
(74) *Attorney, Agent, or Firm*—Burns, Doane, Swecker & Mathis, LLP

(57) ABSTRACT

A printhead includes a common ink chamber or reservoir bounded on one side by a membrane having nozzle apertures. The membrane forms a print face of the printhead. Piezoelectric elements (piezos) are located on the membrane near the nozzles. The piezos flex segments of the membrane surrounding the nozzles to eject ink droplets from the nozzle apertures. Ribs are also provided on the membrane and define boundaries of the membrane segments corresponding to the nozzles. The ribs can isolate each nozzle from the other nozzles, in two ways. First, the ribs act as stiffeners so that when piezos attached to one membrane segment flex that membrane segment, the other membrane segments are not significantly flexed. Second, when the ribs are provided on an interior surface of the membrane, they deflect the pressure pulse in the ink fluid from a flexing membrane segment, upwards, away from adjacent membrane segments/nozzles.

20 Claims, 7 Drawing Sheets

PIEZOELECTRICALLY DRIVEN PRINTHEAD ARRAY

This application claims priority under 35 U.S.C. § 119 to U.S. Provisional Application No. 60/279,658 entitled PIEZOELECTRICALLY DRIVEN PRINTHEAD ARRAY and filed on March 30, 2001, the entire content of which hereby incorporated by reference.

BACKGROUND OF THE INVENTION

1. Field of the Invention

The present invention relates to the field of printing by expelling ink from a print head onto a print medium. More particularly, the present invention relates to piezoelectrically driven ink printheads.

2. Description of Related Art

In the printing arts, ink printheads of various configurations are publically available. Typically, an ink printhead has apertures or nozzles from which ink droplets are expelled onto a print medium, and the ink is routed internally through the printhead. Piezoelectric transducers can be used to generate pressure necessary to expel droplets of ink from the nozzles of the printhead. In situations where a printhead includes multiple nozzles, it is often desirable to be able to selectively expel ink droplets from a specific nozzle and not the other nozzles. Conventional solutions known in the art, isolate the nozzles from each other by long narrow passages that damp pressure surges in the ink fluid provided to the nozzles from a common source. Heaters can also be located at each nozzle, for the purpose of reducing ink viscosity at a specific nozzle. Thus, when a droplet is to be ejected from a specific nozzle, the heater at that nozzle is activated to heat ink at the nozzle so that when a pressure pulse is applied to the ink fluid, the ink viscosity at the nozzle is reduced enough so that a droplet of ink will be expelled from the nozzle, while the higher viscosity of the (colder) ink at the other nozzles remains high enough to prevent ejection of ink droplets from those other nozzles.

However, such conventional designs suffer from various disadvantages. For example, long, narrow passageways for transmitting ink to a particular nozzle are more likely to become clogged, especially when inks with pigment particles are used, or when metallic inks, whose components tend to separate, are used. In addition, when a clog does occur, the length and narrowness of the passageways increases the difficulty of successfully cleaning the printhead and clearing the passageways of blockages. The physical structure of such printheads is also somewhat complicated, and therefore such printheads tend to be more expensive to manufacture.

Accordingly, a need exists for a printhead that is reliable, easy to clean, simple in design, and economical to manufacture.

SUMMARY OF THE INVENTION

In accordance with exemplary embodiments of the present invention, a printhead is provided with a large ink chamber. One side of the ink chamber is formed by a membrane. Nozzles for expelling ink from the printhead are formed by apertures in the membrane, and piezoelectric actuators (hereafter "piezo") are provided near each nozzle aperture, on the membrane. The piezos expel ink from a nozzle aperture by flexing the membrane at the aperture to create a pressure pulse in the ink fluid near the aperture, that is sufficient to expel a droplet of ink fluid through the nozzle aperture. Ribs are also provided on the membrane, to separate or isolate adjacent nozzle apertures. In accordance with an exemplary embodiment of the invention, the ribs isolate a nozzle aperture in the membrane from the other nozzle apertures in the membrane by supporting a boundary of a membrane segment surrounding the isolated nozzle aperture. Thus, when the piezos on the membrane segment of the isolated nozzle aperture are actuated to flex the membrane segment of the nozzle aperture, the ribs act as stiffeners to bound the flexing so that the actuated piezos do not also flex other parts of the membrane beyond the membrane segment of the nozzle aperture.

In accordance with another exemplary embodiment of the invention, the ribs protrude slightly into the common ink chamber of the printhead. Thus when a membrane segment of a nozzle aperture is flexed by the piezos attached to it, the resulting pressure pulse in the ink fluid of the common chamber will tend to be deflected upwards or away from the membrane segment. This is because the ribs surrounding or bounding the membrane segment, act as a fence to deflect or inhibit the pressure pulse from traveling laterally along the membrane through the ink fluid to adjacent nozzle apertures.

These effects, along with the natural damping effects of the ink fluid and dissipation of the pressure pulse as it expands away from its origin, prevent ink droplets from being expelled from nozzle apertures in the membrane whose piezos have not been activated.

In accordance with other exemplary embodiments of the invention, the piezos can be provided either on the outside of the membrane, or on the inside of the membrane immersed in the ink fluid inside the common ink chamber. Stiffening ribs bounding or defining nozzle aperture membrane segments can also be provided on the outer surface of the membrane, in addition to or instead of, ribs provided on an interior surface of the membrane inside the common ink chamber. In accordance with another exemplary embodiment of the invention, ribs can be provided on an inside surface of the membrane, within the common ink chamber, in a configuration that impedes lateral travel of a pressure pulse in the ink fluid along the surface of the membrane, without increasing local rigidity of the membrane. The ribs can be formed using a material different from the membrane, or can be formed using the same material. The ribs can be formed by providing the membrane with additional thicknesses at appropriate locations. The ribs can also be formed by corrugating the membrane at appropriate locations.

BRIEF DESCRIPTION OF THE DRAWINGS

The objects and advantages of the present invention will be further understood by reading the following detailed description in conjunction with the drawings, wherein.

DETAILED DESCRIPTION OF THE INVENTION

In accordance with exemplary embodiments of the invention, a printhead includes a central ink reservoir having a surface formed by a membrane. The membrane forms the print face of the printhead, and has nozzle apertures extending through the membrane into the central ink fluid reservoir. Piezos are provided near each nozzle aperture, to flex the membrane and inject ink from the central reservoir through the nozzle aperture. Ribs are also provided to isolate the nozzle apertures from each other, by a) acting as stiffeners attached to the membrane to limit flexing of the membrane to a membrane segment surrounding a nozzle aperture and bounded by the ribs, and/or b) provide a (preferably low) fence around a nozzle aperture on the inside surface of the membrane, thereby to deflecting pressure pulses in the ink fluid generated by actuation of the piezos, upward and away from laterally adjacent nozzle apertures.

Figure 1:
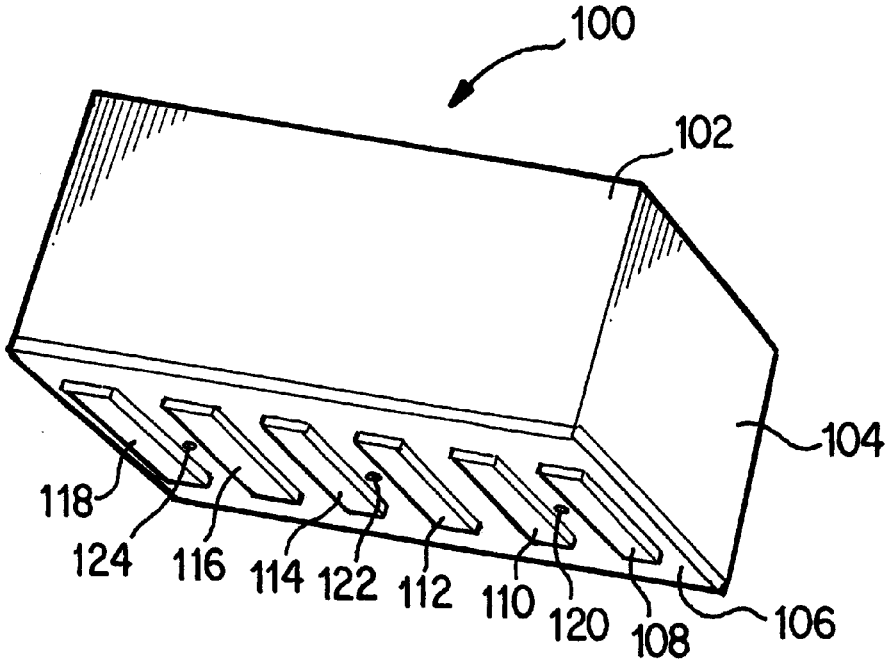
FIG. 1 illustrates a side perspective view of an exemplary printhead in accordance with the invention.
Figure 2:
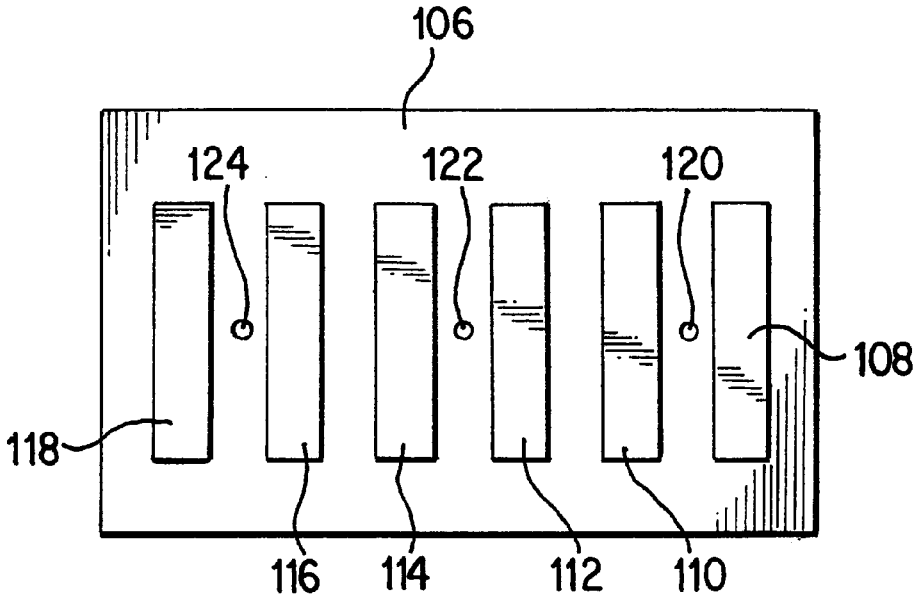
FIG. 2 illustrates a bottom view of the printhead of FIG. 1.

FIG. 1 illustrates a first exemplary embodiment of such a printhead, having a single row of three nozzle apertures 120–124 in a membrane 106. As can be seen in FIG. 1, the printhead 100 is shown from a side perspective view from the bottom, where the print face of the printhead 100 is oriented downwards. Piezos 108–118 are attached to the membrane 106 near corresponding nozzle apertures 120–124. Chamber side walls 102, 104, together with the membrane 106, form a central ink chamber or reservoir that supplies all of the nozzle apertures 120–124. The print face (e.g., the membrane 106) of the printhead 100 is preferably oriented downwards toward a printing medium such as paper, so that the membrane 106 forms the bottom surface of the printhead 100 and the bottom of the central ink chamber of the printhead 100. The chamber side walls 102, 104 form side walls of the printhead 100 and its central ink chamber or reservoir.

Preferably the top of the central ink chamber or reservoir is left open, or is loosely (not hermetically) sealed. This confers several advantages. For example, bubbles in the ink fluid in the reservoir will migrate upwards, away from the nozzle apertures 120–124. In addition, since the central ink chambers/reservoir is open at the top or loosely sealed, gas bubbles can easily vent and therefore will not interfere with or degrade performance of the printhead 100.

Orienting the print face of the printhead downwards has the additional advantage that gravity will ensure that most of the ink in the central reservoir can be used or printed, and also allows any gas bubbles in the ink to vent upwards, away from the nozzle apertures. Of course, those of ordinary skill in the art will realize that the printhead can be appropriately adapted so that the nozzle apertures can be aimed in any desired direction, for example sideways, or even upwards. For example, the chamber can be configured to have an opening on its upper side regardless of how the nozzle apertures are oriented, and/or ink fluid can be supplied to the central chamber or reservoir under an appropriate pressure.

Figure 3:
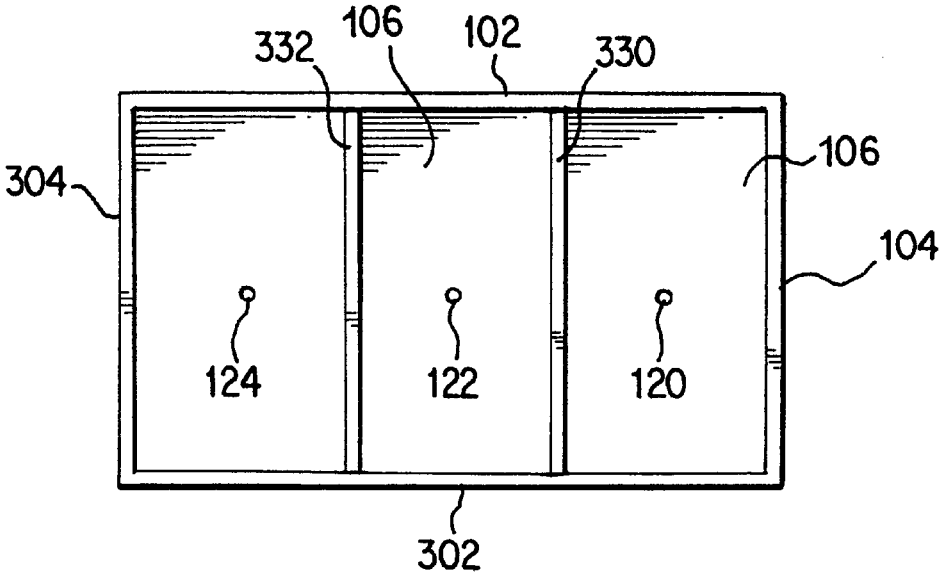
FIG. 3 illustrates a top view of the printhead of FIG. 1, looking down into an interior of the printhead.

FIG. 3 shows a top view of the printhead 100, looking down into the central ink chamber. In particular, the central ink chamber or reservoir is bounded on the sides by the chamber side walls 102, 104, 302 and 304, and has a bottom formed by the membrane 106. Ribs 330, 332 are provided to isolate the nozzle apertures from each other.

Figure 4:
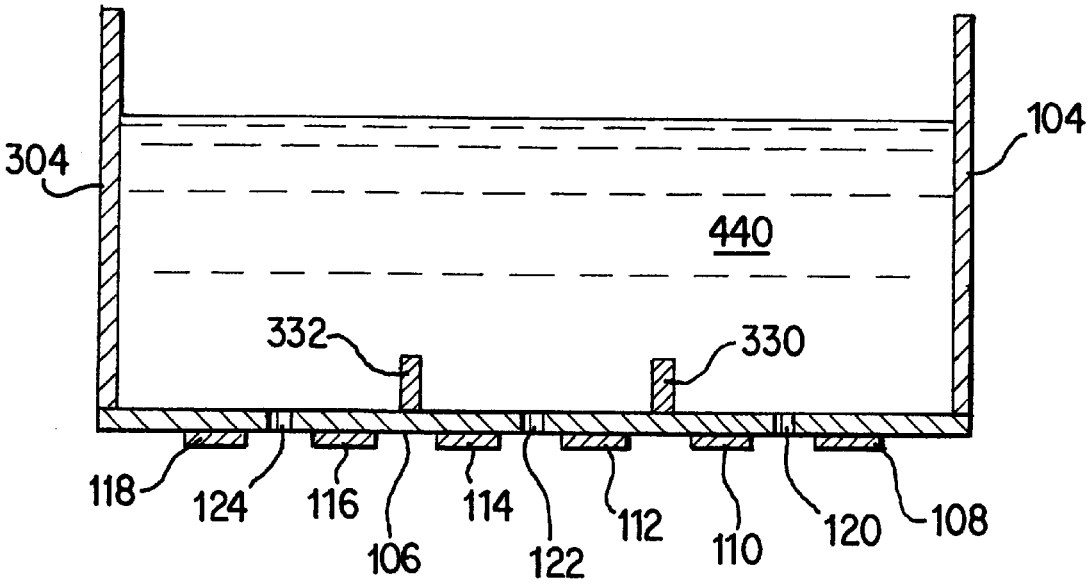
FIG. 4 illustrates a side cross sectional view of the printhead of FIG. 1.

FIG. 4 is a side cross sectional view of the printhead 100 of FIG. 1. As shown in FIG. 4, ink 440 is provided in the central chamber or reservoir of the printhead 100, and the ribs 330, 332 extend into the central chamber.

Figure 5:
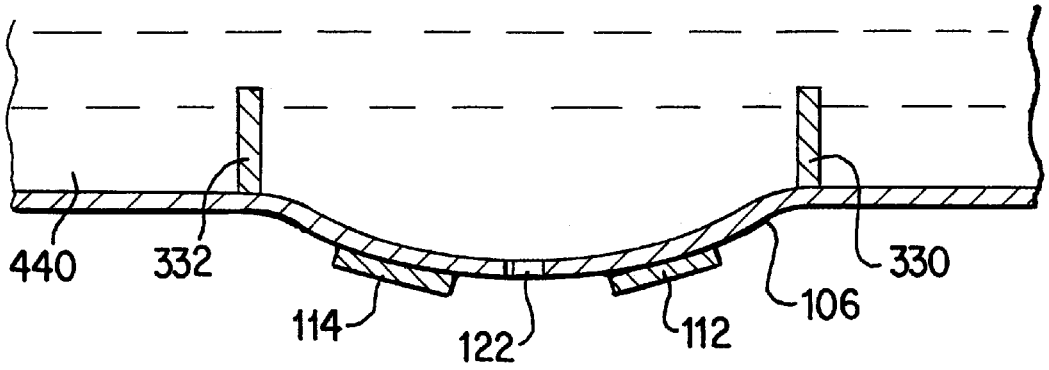
FIG. 5 shows a first stage of actuation of a nozzle aperture of the printhead of FIG. 1, in accordance with an exemplary embodiment of the invention.

FIG. 5 shows an initial part of a process wherein ink is expelled from the nozzle aperture 122 of the printhead 100. In particular, FIG. 5 shows a stage wherein the piezos 112, 114 have been actuated to flex the membrane segment containing the nozzle aperture 122 and bounded by the ribs 330, 332, outward. After the membrane segment of the nozzle aperture 122 has been flexed outward by the piezos 112, 114, the piezos 112, 114 can then by actuated to drive the membrane segment vigorously inward, so that an ink droplet 642 is expelled from the nozzle aperture 122 as shown in FIG. 6.

Figure 6:
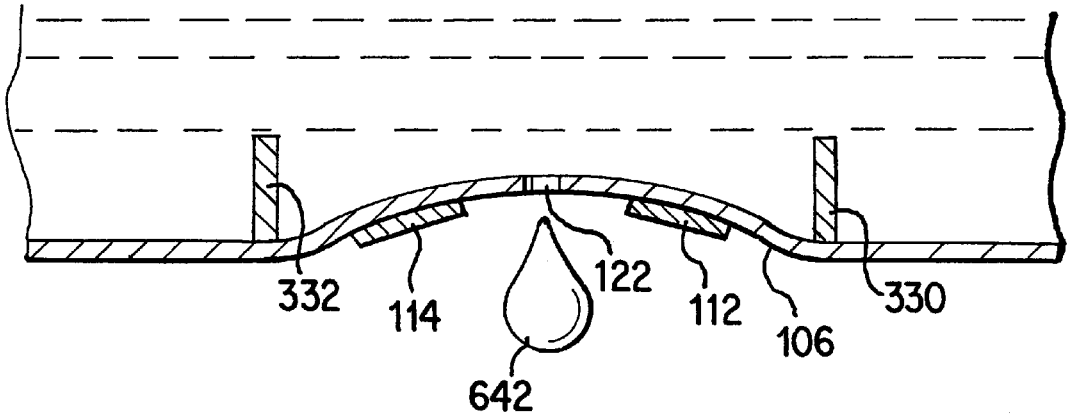
FIG. 6 illustrates a second stage of actuation of a nozzle aperture of the printhead of FIG. 1, in accordance with exemplary embodiments of the invention.

FIG. 6 shows the membrane segment containing the nozzle aperture 122, flexed inward by the piezos 112, 114. Preferably, the piezos 112, 114 are first gently actuated to deflect the membrane segment containing the nozzle aperture 122 outwards to gather ink near the nozzle aperture 122, and then the piezos 112, 114 are actuated rapidly with greater force to develop sufficient fluid pressure in the ink volume near the nozzle aperture 122, so that a portion of the ink 440 will be expelled through the nozzle aperture 122 and exit the nozzle aperture 122 as an ink droplet 642. Persons of ordinary skill in the art will recognize that the piezos can be actuated in different ways, to expel ink droplets. For example, instead of distending the membrane segment outwards and then sharply inwards, the membrane segment could instead be first flexed sharply inwards to expel and ink droplet, and then be allowed to relax to its original, quiescent position.

Persons of ordinary skill in the art will further recognize that the direction of actuation is controlled by the polarity of the voltage applied to the piezos 112, 114. Persons of ordinary skill in the art will also recognize that the force applied by the piezos 112, 114 can be modulated by adjusting or selecting an appropriate magnitude of the voltage applied to the piezos 112, 114.

Those of ordinary skill in the art will also recognize that the diameter or cross sectional area of the nozzle aperture can be appropriately selected, to achieve appropriate ink droplet sizes and exit velocities. For example, a diameter of the nozzle aperture can be any appropriate size, depending on a desired ink droplet size as well as on other factors such as ink viscosity. In an exemplary embodiment of the invention, the nozzle aperture is selected from a range 10 to 200 microns. The timing, magnitude, duration, and polarity of the voltages applied to the piezos can also be appropriately selected to achieve desired performance when the invention is used in specific applications. based on characteristics of a particular situation in which the invention is applied. Furthermore, electrical power can be appropriately supplied to the piezos, in accordance with principles well known in the art. For example, where the membrane is electrically conductive it can be used as a ground plane for all of the piezos connected to it, and positive electrical connections can be individually and separately provided for each of the piezos. Accordingly, electrical connections to the piezos are not shown, and are not described in further detail in this document.

Those of ordinary skill in the art will also appreciate that the area of the membrane segment containing the nozzle aperture 122 and bounded by the ribs 330, 332, also affects operation of the printhead, for example by affecting a swept ink volume between extreme positions of the membrane segment, when the membrane segment is flexed by the corresponding piezos attached to it.

The membrane can be any appropriate thickness. In an exemplary embodiment of the invention, a thickness of the membrane is selected from a range of 20 microns to several hundred microns. The membrane can be made of any appropriately flexible material. The membrane can for example, be made of brass, stainless steel, aluminum alloy, LEXON™, metallic polymers, or any other suitable material.

In an exemplary embodiment of the invention, the ribs are about twice as thick as the membrane, and have a height that is about four times the thickness of the membrane. However, the ribs can have different dimensions or configurations, that provide appropriate levels of stiffness and/or fluid pressure deflection. In an exemplary embodiment of the invention, the ribs have a thickness that is selected from a range 20 microns to several hundred microns, with a height selected from a range of 20 microns to several hundred microns. In accordance with an exemplary embodiment of the invention, the ribs are preferably 3–4 times as stiff as the membrane. In accordance with an exemplary embodiment of the invention, the ribs are made of a hard material having a high Young's modules. The ribs can, for example, be made of stainless steel, with a height selected from a range of 50 microns to 100 microns.

Figure 7:
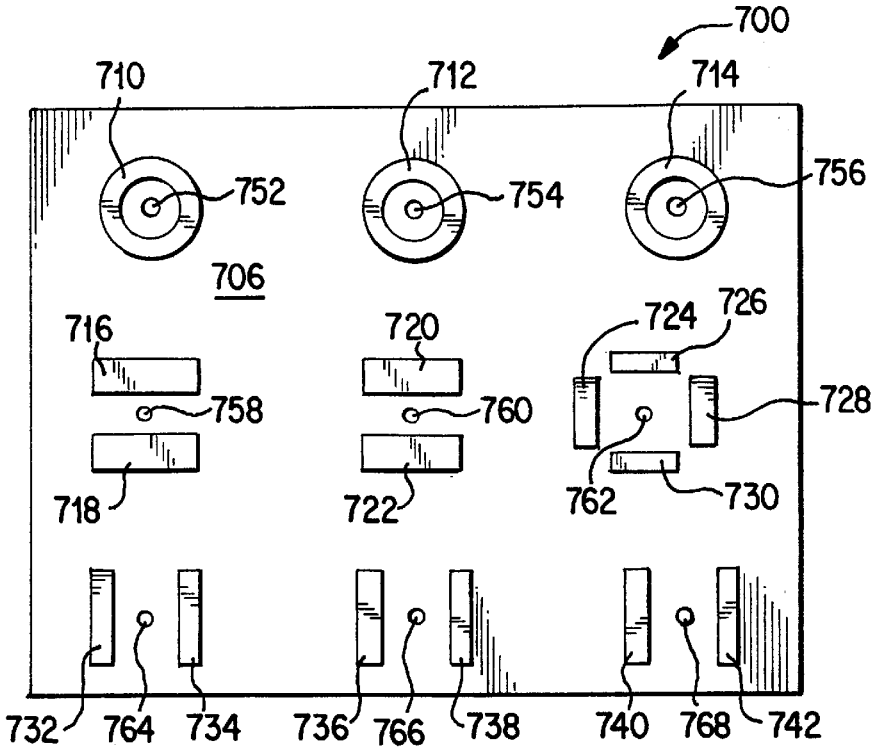
FIG. 7 illustrates a bottom view of an exemplary embodiment of a printhead in accordance with the invention, wherein the printhead includes a two dimensional array of nozzles with a variety of piezo configurations.

Although FIG. 1 shows a printhead 100 having a single row of nozzle apertures, printheads having multiple rows of nozzles can also be provided in accordance with exemplary embodiments of the present invention. For example, FIG., 7 shows a printhead 700 having nine nozzle apertures 752–768 arranged in a 3×3 array. As shown in FIG. 7, the piezos corresponding to the nozzle apertures can also be provided in various configurations. The piezos 710–714 are provided in a circular arrangement, respectively surrounding the nozzle apertures 752–756. Piezos can also be provided as long, slender rectangular strips mounted adjacent to respective nozzle apertures, as shown by the piezo pairs (732, 734), (736, 738), (740, 742) mounted respectively adjacent to the nozzle apertures 764, 766, 768. The height-to-width ratios of the rectangular piezos can also be adjusted, as shown by the piezos (716, 718), (720, 722) mounted respectively adjacent to the nozzle aperture 758, 760, to have a lower height-to-width ratio. In addition, rectangular piezos can be arranged to effectively surround a nozzle aperture as shown by the piezos 724, 726, 728, 730 arranged around the nozzle aperture 762. In accordance with exemplary embodiments of the invention, piezos for expelling ink droplets from the nozzle apertures can be provided in any appropriate configuration.

Figure 8:
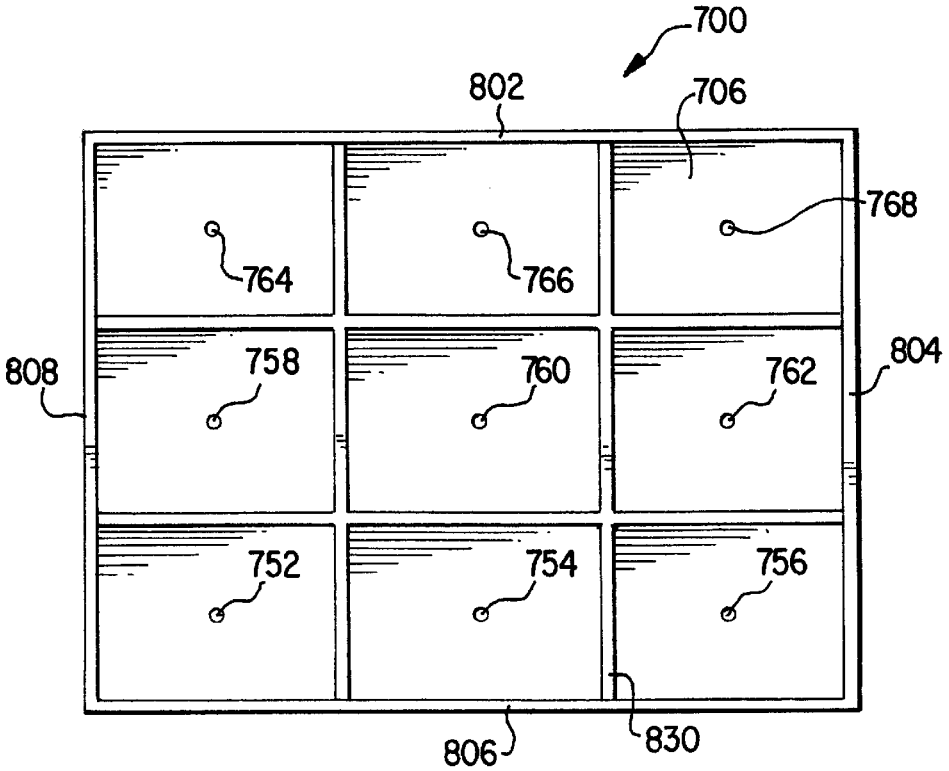
FIG. 8 illustrates a top view of the printhead of FIG. 7, looking down into the common ink chamber.

While FIG. 7 is a bottom view of the printhead 700, FIG. 8 is a top view of the printhead 700. As shown in FIG. 8, looking down into an open, common ink chamber or reservoir, chamber side walls 802, 804, 806 and 808 bound the chamber on the sides, and the membrane 706 bounds the chamber on the bottom. Ribs 830 are provided to isolate the nozzle apertures 752–768 from each other, by limiting flexion of the membrane 706 to a specific membrane segment surrounding a nozzle aperture and bounded by the ribs 830, and/or deflecting fluid pressure pulses generated by flexion of a membrane segment upward and away from adjacent nozzle apertures.

Figure 9:
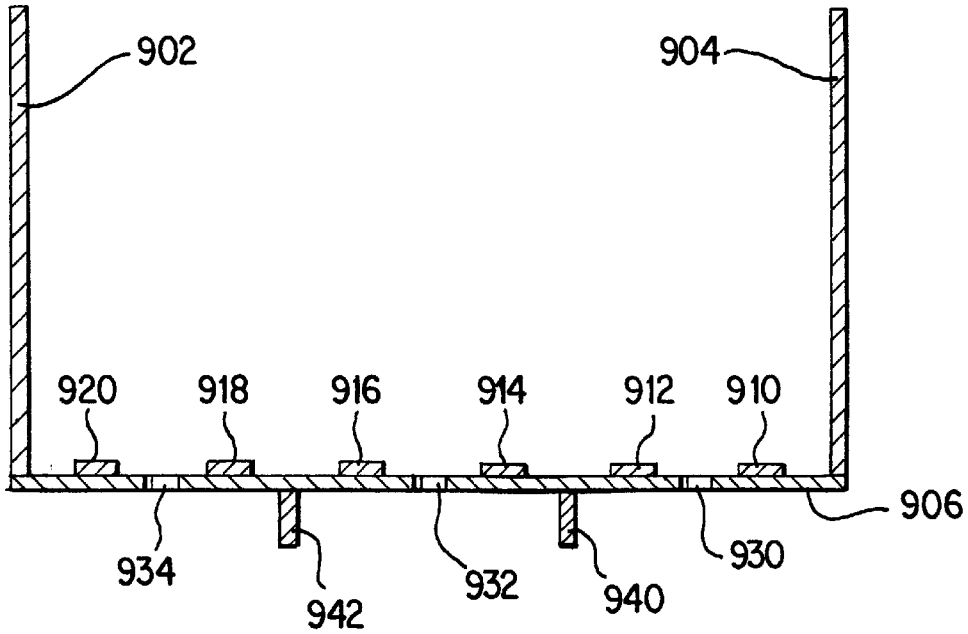
FIG. 9 illustrates an exemplary embodiment of the invention, wherein piezos are provided on an interior surface of the membrane, and stiffener ribs are provided on an exterior surface of the membrane.

In accordance with an exemplary embodiment of the invention, a printhead having chamber side walls 902, 904 and a bottom formed by a membrane 906 with nozzle apertures 930, 932 and 934 can have stiffening ribs 940, 942 located on an exterior surface of the membrane 906, to isolate flexion of the membrane 906 to a particular membrane segment surrounding a nozzle aperture and bounded by one or more of the ribs 940, 942. As shown in FIG. 9, in accordance with an exemplary embodiment of the invention, piezo pairs (910, 912), (914, 916), (918, 920) corresponding respectively to nozzle apertures 930, 932 and 934, can be located on an interior surface of the membrane 906, within the common ink chamber or reservoir. In this case, electrical connections to the piezos, as well as the piezos themselves, would need to be insulated if an electrically conductive ink were used.

Figure 10:
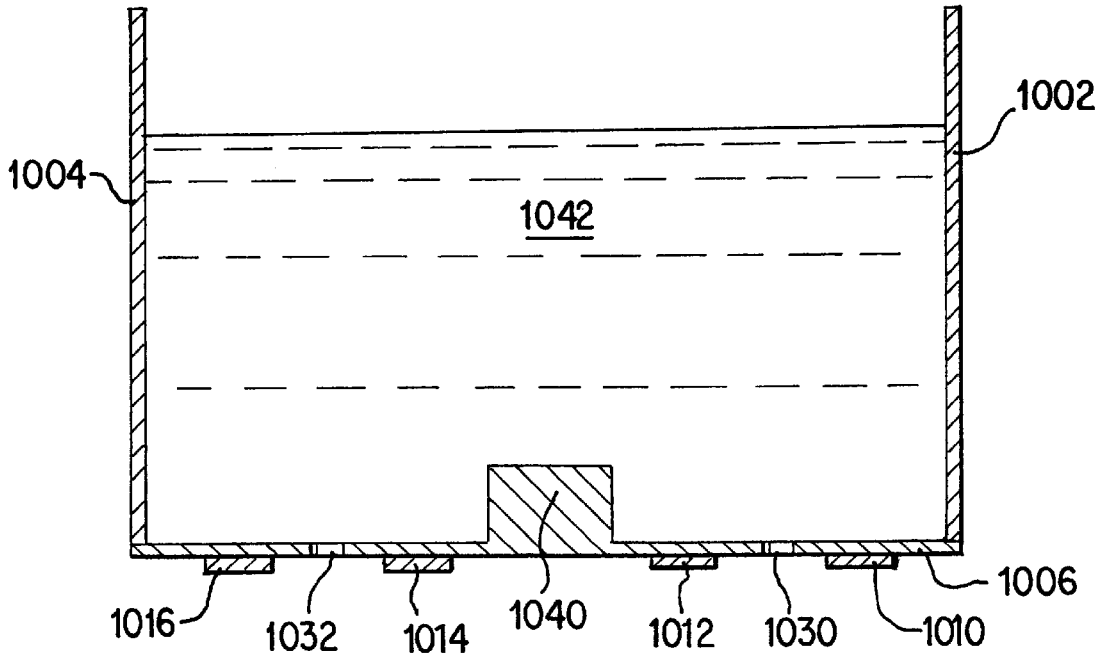
FIG. 10 illustrates an exemplary embodiment of the invention, wherein a rib in the membrane is formed by an increased thickness of the membrane.

In accordance with an exemplary embodiment of the invention shown in FIG. 10, a rib can be formed by an additional thickness of the membrane. FIG. 10 shows a common ink reservoir of a printhead, having chamber side walls 1002, 1004 and a bottom formed by a membrane 1006 with nozzle apertures 1030, 1032. Piezos (1010, 1012), (1014, 1016) are provided to respectively actuate the nozzle apertures 1030, 1032. A rib 1040 is also provided to perform the function(s) described above with respect to the other embodiments. In this embodiment however, the rib 1040 is formed by an additional thickness of the membrane 1006. Preferably, the height and width of the rib 1040 are about four times the normal thickness of the membrane 1006. However, the rib 1040 can be appropriately sized using different dimensions to provide desired results depending on the specific circumstances of a particular application.

Figure 11:
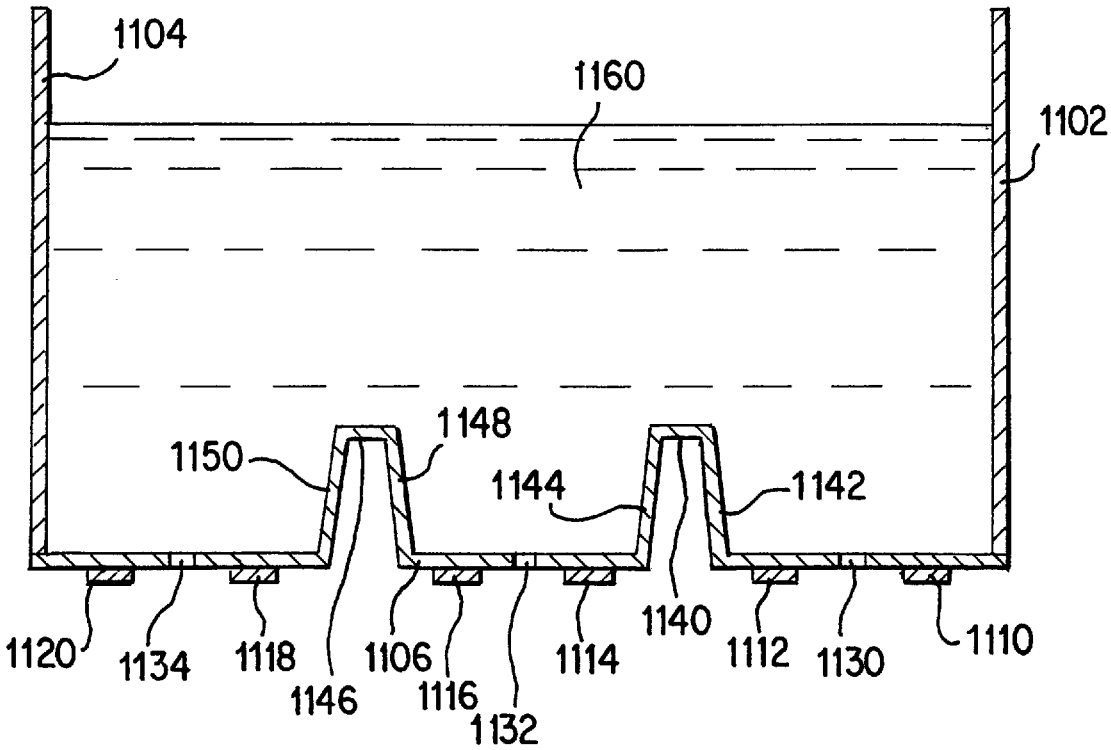
FIG. 11 illustrates an exemplary embodiment of the invention, wherein ribs are formed by corrugations in the membrane.

In accordance with another exemplary embodiment of the present invention, ribs can be provided by corrugating the membrane. In particular, FIG. 11 shows an ink chamber or reservoir of a printhead, wherein the chamber side walls 1102, 1104 bound the chamber on the sides, and a membrane 1106 with nozzle apertures 1130, 1132, 1134 forms a bottom and also a print face of the common ink chamber and printhead. As shown in FIG. 11, piezos (1110, 1112), (1114, 1116), (1118, 1120) are provided on the membrane 1106 near the nozzle apertures 1130, 1132, 1134 respectively. Ribs 1140, 1146 are also provided to isolate the nozzle apertures 1130–1134 from each other. As can be seen from FIG. 11, the ribs 1140, 1146 are formed as corrugations of the membrane 1106, so that each rib has two side walls. In particular, the rib 1140 has rib side walls 1142, 1144; and rib 1146 has rib side walls 1148, 1150. Ink 1160 is shown provided in the ink chamber, which is preferably oriented so that the membrane (which forms the print face of the printhead) faces downward.

Figure 12:
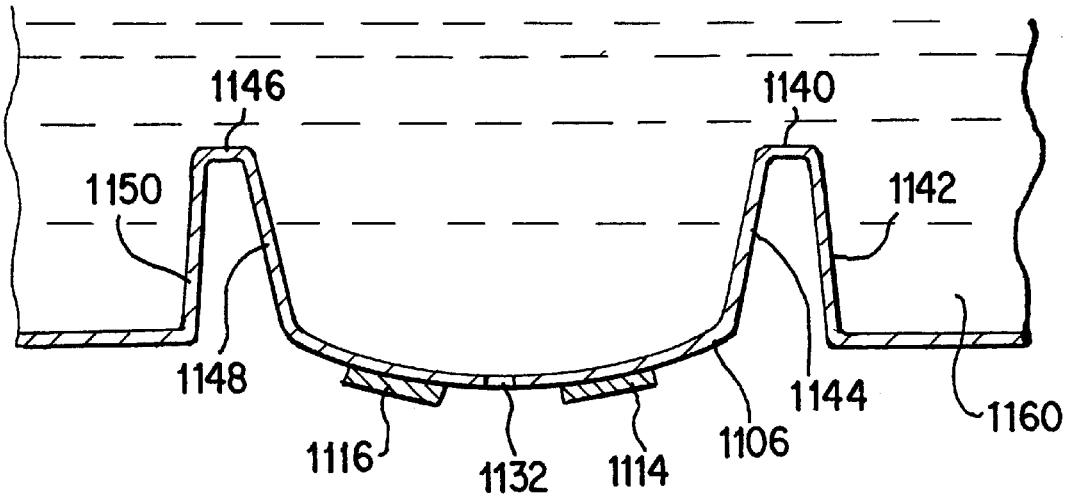
FIG. 12 illustrates a first stage of an exemplary actuation of a nozzle of the printhead shown in the FIG. 11.
Figure 13:
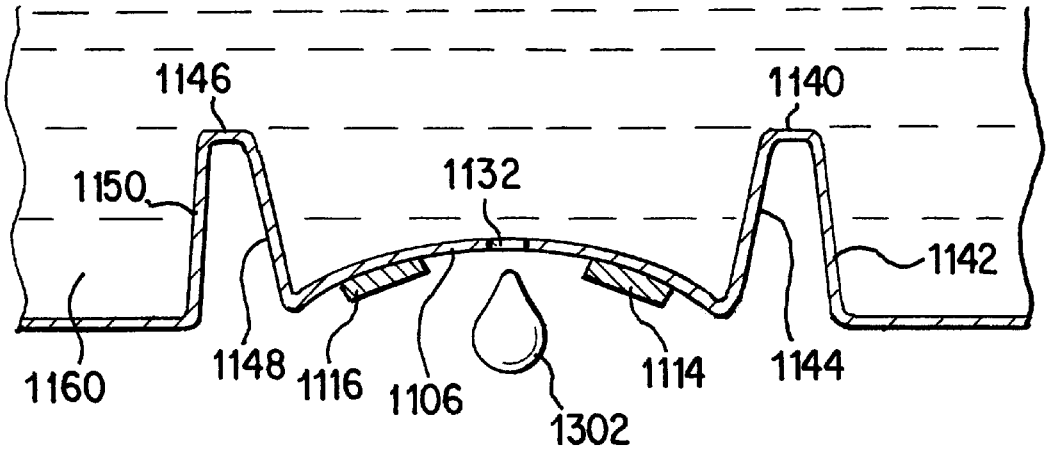
FIG. 13 shows a second stage of an exemplary actuation of a nozzle of the printhead shown in FIG. 11.

FIGS. 12 and 13 show actuation of the piezos 1114, 1116 to expel ink from the nozzle aperture 1132 of FIG. 11. These operations are similar to those shown in FIGS. 5–6, and are therefore not described in further detail except to point out that the rib side walls 1148, 1114 adjacent to the nozzle aperture 1132, flex as the piezos 1114, 1116 deflect the membrane segment bounded by the ribs 1140, 1146 outward and then inward. As shown in FIGS. 12, 13, the opposite or outer rib side walls 1142, 1150 do not flex as the ink droplet 1302 is expelled from the nozzle aperture 1132, thereby isolating the other nozzle apertures 1130, 1134 and their corresponding membrane segments.

Although specific embodiments of the present invention have been described above and shown in the accompanying Figures, other variations incorporating the inventive concepts described above are also possible. For example, the printhead can have any appropriate number of nozzles. The number of nozzles can range, for example, from several nozzles to hundreds or thousands or nozzles. External dimensions of the printhead can also vary appropriately. In accordance with an exemplary embodiment of the invention, a depth of the printhead structure can range from a fraction of a millimeter to several millimeters. In accordance with an exemplary embodiment of the invention, a height of the printhead structure can range from several millimeters to several centimeters. Generally, printheads in accordance with the present invention can have any appropriate size and/or proportion.

The present invention confers numerous advantages. For example, the structure is simple and can be easily and economically manufactured. Since there are no channels between the central ink reservoir and the nozzle apertures, clogging is avoided. Furthermore, when clogging of the nozzle apertures does occur, the relatively large size of the common ink chamber or reservoir and open nature of the printhead allows the printhead to be easily and efficiently flushed clean, thus making it ideally suited for use with such inks as pigmented inks and metallic inks. In addition, especially when the printhead is oriented with the printing face downwards, air bubbles in the ink do not adversely affect operation of the printhead because the bubbles easily migrate upwards and away from the nozzle apertures due to the affects of gravity. In addition, when the top of the common ink chamber is open or is loosely sealed, the bubbles can easily vent from the chamber.

In summary, an exemplary printhead in accordance with the invention includes a common ink chamber or reservoir bounded on one side by a membrane having nozzle apertures, wherein the membrane forms a print face of the printhead, includes piezoelectric elements located on the membrane near the nozzle apertures to flex segments of the membrane surrounding the nozzle apertures to eject ink droplets from the nozzle apertures. Stiffening ribs are also provided on the membrane. When the ribs provide structural stiffness, they define boundaries of the membrane segments surrounding corresponding nozzle apertures. The ribs isolate each nozzle aperture from the other nozzle apertures, in two ways. First, the ribs act as stiffeners so that when piezos corresponding to a particular nozzle aperture are actuated to deflect the membrane segment that surrounds the nozzle aperture and is bounded by ribs, adjacent membrane segments corresponding to adjacent nozzle apertures are not significantly flexed. In addition when the ribs are provided on an interior surface of the membrane and extend somewhat into the ink chamber, they act to deflect the pressure pulse in the ink fluid generated by actuation of the piezos attached to the membrane segment, upwards, away from adjacent nozzle apertures. In this way, a single common ink chamber or reservoir can provide ink to multiple nozzle apertures without long, narrow or labyrinthine subchambers or passageways, while at the same time allowing the nozzle apertures to be separately and selectively activated. Thus an ink droplet can be ejected from any one of the nozzle apertures without causing ink to exit any of the other non-actuated nozzle apertures in the printhead. The ribs can alternatively be formed to provide only one or the other of these two functions. Thus, one or both of these functions can be provided, in the same ribs or in separate ribs. The ribs can be formed using the same material as the membrane, or using different material from the membrane. The ribs can also be formed as corrugations in the membrane.

The printhead of the present invention can be used in a printer for use with a personal computer, and can be used to print images or indicia on various substrate media including paper, cardboard, packing material, cigarette cartons and wrappers, and so forth. The printhead is compatible with all conventional fluid inks, including metallic inks.

The present invention has been described with reference to exemplary embodiments. However, it will be readily apparent to those skilled in the art that it is possible to embody the invention in specific forms other then those described above without departing from the spirit of the invention. The various aspects and exemplary embodiments are illustrative, and they should not be considered restrictive in any way. The scope of the invention is given by the appended claims, gather than the proceeding description, and all variations and equivalence thereof which fall within the range of the claims are intended to be embraced therein.

What is claimed is:

1. A printhead, comprising:

a print fluid reservoir;

a membrane forming a side of the reservoir;

a plurality of nozzle apertures in the membrane;

for each nozzle aperture, ribs attached to the membrane to isolate a segment of the membrane surrounding the nozzle aperture from movement of the membrane at a different location, wherein the ribs extend into the reservoir a distance less than four times a thickness of the membrane; and for each nozzle aperture, at least one piezoelectric element attached to the isolated segment of the membrane surrounding the nozzle aperture.

2. The printhead of claim 1, wherein the ribs are attached to the membrane on the interior of the print fluid reservoir.

3. The printhead of claim 1, wherein the ribs are formed as corrugations in the membrane.

4. The printhead of claim 1 wherein the ribs have a stiffness about four times greater than a stiffness of the membrane.

5. The printhead of claim 1, wherein the ribs are formed by an additional thickness of the membrane.

6. The printhead of claim 1, wherein the membrane comprises at least one of brass, stainless steel, aluminum, LEXON™, and metallic polymer.

7. The printhead of claim 1, wherein the membrane forms a ground plane for the at least one piezoelectric element.

8. The printhead of claim 1, wherein the membrane forms a bottom side of the print fluid reservoir.

9. The printhead of claim 1, wherein each of the plurality of nozzle apertures has a diameter in the range of 10 to 200 microns.

10. The printhead of claim 1, wherein the ribs have a thickness ranging from 20 to 300 microns and a height ranging from 20 to 300 microns.

11. The printhead of claim 1, wherein the ribs are formed of stainless steel.

12. The printhead of claim 11, wherein the ribs have a height ranging from 50 microns to 100 microns.

13. The printhead of claim 1, wherein the ribs are formed on an outer surface of the membrane.

14. The printhead of claim 1, wherein the at least one piezoelectric element comprises a pair of piezoelectric elements mounted on opposite sides of the nozzle aperture.

15. The printhead of claim 1, wherein the at least one piezoelectric element comprises a circular piezoelectric element surrounding the nozzle aperture.

16. A method for operating the printhead of claim 1, comprising:

for at least one of the nozzle apertures, actuating the corresponding at least one piezoelectric element to flex the corresponding isolated segment of the membrane outward; and then actuating the corresponding at least one piezoelectric element to flex the corresponding isolated segment of the membrane inward to expel print fluid from the print fluid reservoir through the nozzle aperture.

17. The method of claim 16, comprising:

expelling print fluid through at least one of the nozzle apertures onto a substrate to form indicia on the substrate, the substrate comprising at least one of paper, plastic, foil, a cigarette carton, a wrapper of a cigarette pack, cardboard, a label, and a print fluid receptive surface.

18. The method of claim 16, wherein in the step of actuating the at least one piezoelectric element to flex the corresponding isolated segment of the membrane inward, the corresponding isolated segment of the membrane moves past a quiescent position and then returns to the quiescent position.

19. The printhead of claim 1, wherein a top of the print fluid reservoir is open to the atmosphere.

20. A printhead, comprising:

a print fluid reservoir;

a membrane forming a side of the reservoir;

a plurality of nozzle apertures in the membrane;

for each nozzle aperture, ribs attached to the membrane to isolate a segment of the membrane surrounding the nozzle aperture from movement of the membrane at a different location; and for each nozzle aperture, at least one piezoelectric element attached to the isolated segment of the membrane surrounding the nozzle aperture;

wherein a top of the print fluid reservoir is open to the atmosphere.

* * * * *